US007356956B2

(12) United States Patent
Schinazi et al.

(10) Patent No.: US 7,356,956 B2
(45) Date of Patent: Apr. 15, 2008

(54) MECHANISM FOR COUNTING ROUNDS FIRED FROM A RECOIL GUN

(76) Inventors: Robert G. Schinazi, 320 Pomelo Dr., Apt. #193, Vista, CA (US) 92081; Lauren E. de Rosset, 320 Pomelo Dr., Apt. #193, Vista, CA (US) 92081

( * ) Notice: Subject to any disclaimer, the term of this patent is extended or adjusted under 35 U.S.C. 154(b) by 0 days.

(21) Appl. No.: 11/292,790

(22) Filed: Dec. 2, 2005

(65) Prior Publication Data

US 2008/0052976 A1 Mar. 6, 2008

Related U.S. Application Data

(60) Provisional application No. 60/633,189, filed on Dec. 3, 2004.

(51) Int. Cl.
*F41A 9/53* (2006.01)

(52) U.S. Cl. ..... 42/1.01; 235/91 R

(58) Field of Classification Search ..... 42/1.01, 42/1.02; 346/38; 235/105, 91 H, 91 R
See application file for complete search history.

(56) References Cited

U.S. PATENT DOCUMENTS 1,479,138 A * 1/1924 Hazelton ..... 89/1.1
1,581,196 A * 4/1926 Gocke ..... 235/91 PR
2,377,011 A 5/1945 Huenergardt
3,130,906 A * 4/1964 Fischer ..... 235/91 R
3,453,882 A 7/1969 Kirkendall et al.
3,552,053 A 1/1971 Jarvis
3,792,638 A 2/1974 Cox et al.
4,001,961 A * 1/1977 Johnson et al. ..... 42/1.03
4,102,074 A 7/1978 Andre
4,146,987 A 4/1979 Hudson et al.
4,202,560 A * 5/1980 Inbody ..... 280/124.126
4,372,192 A 2/1983 Lienau
5,033,217 A * 7/1991 Brennan ..... 42/1.01
5,406,730 A * 4/1995 Sayre ..... 42/1.02
5,566,486 A * 10/1996 Brinkley ..... 42/1.02
6,817,239 B2 11/2004 Glock
7,100,437 B2 * 9/2006 Johnson et al. ..... 73/167
2006/0096144 A1 * 5/2006 Delgado ..... 42/1.01

* cited by examiner

*Primary Examiner*—Michael J. Carone
*Assistant Examiner*—Benjamin P Lee
(74) *Attorney, Agent, or Firm*—Dority & Manning, P.A.

(57) ABSTRACT

A counting mechanism for detecting and registering the number of rounds fired from a recoil gun includes a housing that can be mounted to a component of the gun that exhibits recoil motion upon firing of a round. A counting device is contained within the housing and includes an actuator that is activated by the recoil motion of the gun component upon a round being discharged. A weighted mass is movable within the housing with the recoil motion of the gun component, and the actuator is operably configured with the mass such that movement of the mass resulting from the recoil motion actuates the actuator and increments the counting device.

14 Claims, 4 Drawing Sheets

Fig. 1B
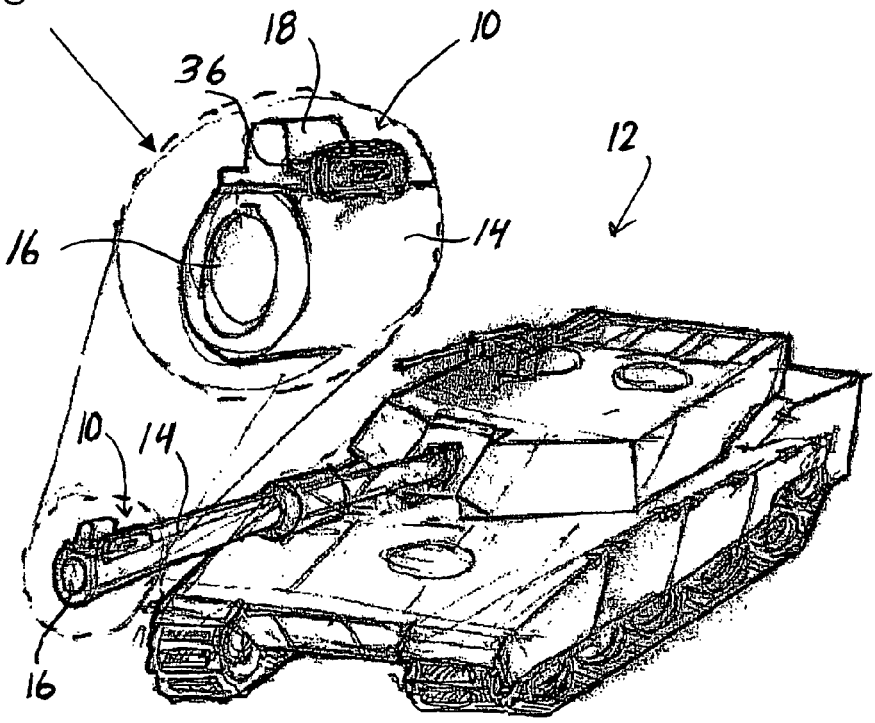
Fig. 1A
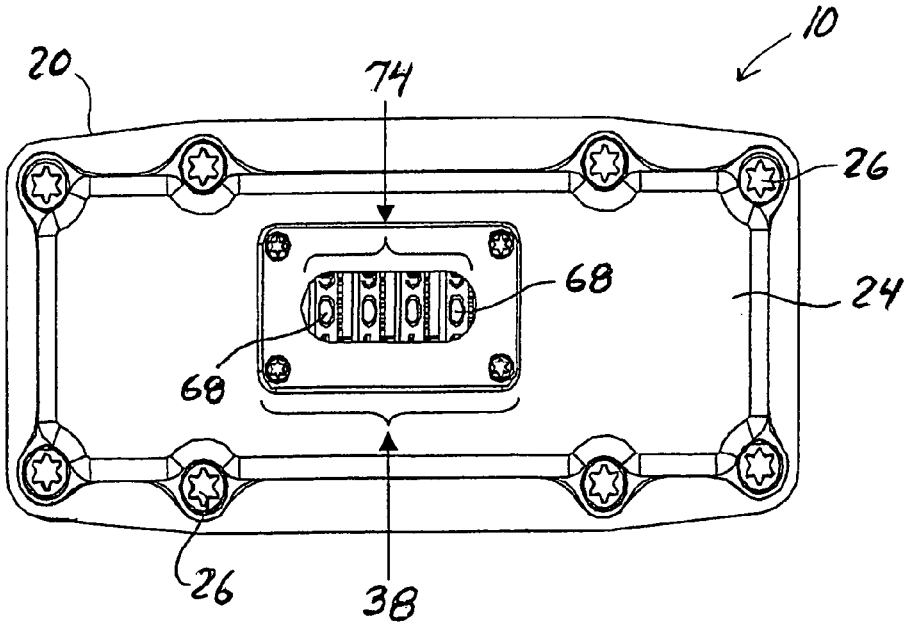
Fig. 2

MECHANISM FOR COUNTING ROUNDS FIRED FROM A RECOIL GUN

PRIORITY CLAIM

The present application claims priority to Provisional Application Ser. No. 60/633,189 filed Dec. 3, 2004.

FIELD OF THE INVENTION

The present invention relates generally to the field of devices that count projectiles fired from gun, and more specifically to counters used to track the number of rounds fired from a large caliber gun, such as a cannon or artillery piece.

BACKGROUND OF THE INVENTION

There are various reasons for counting and tracking the number of rounds fired from a gun or large caliber armament piece. Inventory control of ammunition, maintenance schedules, personnel training, and so forth, are generally all a factor of the number of rounds discharged from the weapon. For larger caliber pieces, such as field cannons, artillery pieces, and ship mounted guns, the barrel of the weapon is generally limited to a specified number of uses, and it is important from operational and safety considerations not to exceed this specified number.

In this regard, various mechanical and electrical counter devices have been described in the art for the purpose of tracking the number of rounds fired from a piece of armament. For example, U.S. Pat. Nos. 4,102,074 and 4,146,987 describe an impulse activated counter for weapons that includes an actuator having a reactive weight with an eccentric center of mass. The weight is freely rotatable in a plane within preset limits in response to an externally applied impulse force. The weight applies a torque force to a shaft that, in turn, activates the counter. Means are provided to apply a counter torque to the weight so that the counter is actuated only in response to a resultant torque of a predetermined magnitude generated by the impulse.

U.S. Pat. No. 3,453,882 describes a device to determine when a projectile emerges from the muzzle of a gun. The device records the signal from an electrical circuit containing a photo-duo-diode located in a radial hole near the muzzle of the gun. The signal is recorded as a reference along with a time base, gun chamber pressure, and other data.

The device of U.S. Pat. No. 3,552,053 counts shots fired from a gun by way of a piezo-electric crystal that is clamped to the barrel of the gun. Upon discharge of a shot, the crystal is stressed by transient radial expansion of the barrel and produces an electrical output pulse that is sensed by a threshold detector and counted in a register. U.S. Pat. No. 6,817,239 describes another device that utilizes a piezofilm sensor integrated into a circuit board mounted onto a gun. The piezofilm sensor is deformed by the impulse recoil of the gun and emits a signal to a chip contained in the circuit board, which records the impulse as a count.

U.S. Pat. No. 3,792,638 describes a fluidic artillery round counter that measures the zone charge used to fire the artillery rounds. The device includes a check valve, a capacitance volume, a regulator, a fluidic oscillator, and a counter whose output is fed into a mechanical summing register. The check valve is connected to the gun bore through a small tube, and gas from the gun bore is the actuating source for the device.

Although the above cited patents have suggested various types of counters, the need still exists for a highly reliable yet simple counting mechanism that can withstand the rigors and extreme conditions of a battlefield environment. This need is particularly acute for large caliber guns, such as cannons and artillery pieces.

SUMMARY OF THE INVENTION

Objects and advantages of the invention will be set forth in part in the following description, or may be obvious from the description, or may be learned through practice of the invention.

In accordance with the invention, a rugged and reliable counting mechanism is provided for detecting and counting the number of rounds fired from a recoil gun. The mechanism is simple in design and can withstand the rigors and extreme conditions of a battlefield. Although having particular usefulness for large caliber recoil guns, such as cannons, artillery pieces, and shipboard gun mount systems, the counting mechanism may be used with any weapon or armament piece that exhibits a recoil upon discharge of a round.

The counting mechanism utilizes the inertia of a mass and the acceleration of the recoil event to increment a counter. Each time the gun is fired, the barrel experiences an intense recoil action. Other components of the gun may also experience the recoil and, although it is preferred to mount the counting mechanism to the barrel, it is within the scope and spirit of the invention to mount the inventive counting mechanism to any component of the gun that exhibits a recoil action upon firing a round. The recoil action constitutes a large acceleration component and, in conjunction with a mass, this acceleration can be converted into a force used to increment a counter.

In a particular embodiment of the counting mechanism, a housing is provided with a shape and configuration for mounting to a barrel of the gun, or another component of the gun that experiences the recoil action. The housing may take on any size and shape, and may include a base member and a cover member that is sealed to the base member to protect the internal components of the mechanism. A counting device is contained within the housing and includes an actuator that is activated (i.e., incremented) by the recoil action of the gun component upon a round being fired from the gun. A weighted mass is movable within the housing in response to the recoil motion of the gun component, and the actuator is operably configured with this movable mass such that relative movement between the mass and housing upon discharge of a round produces an increment to the counting device.

The counting device mechanism may contain any manner of conventional mechanically incremented counter. For example, the counter may be a geared incrementing counter having a cam or gear that is incremented by the actuator, and which in turn increments downstream read-out gears. The read-out gears sequentially increment as discharge events are registered by the counting mechanism. In one embodiment, the counter and its associated actuator may be fixedly mounted within the housing, and a separate weighted mass is movable within the housing. Upon a recoil action, relative movement between the weighted mass and the housing causes the mass to engage the actuator, which results in indexing of the counter.

In an alternate embodiment that requires fewer components and takes advantage of the weight of certain components of the counting device, the counter is movably mounted within the housing and also functions as the weighted mass. For example, the counter may be linearly slidable within the housing and have friction reducing sliders for this purpose. The counter includes an actuator that is triggered to index the counter upon the counter moving to a defined position within the housing, for example by contacting structure within the housing as the counter moves. In an embodiment wherein the actuator moves in a plane generally transverse to movement of the counter, the actuator may be driven in this transverse direction by engagement with a cam track defined within the housing. It should be appreciated that any number of configurations and transfer devices may be utilized to transfer movement of the weighted mass relative to the housing to the actuator.

A spring or other suitable resilient device may be disposed within the housing to oppose the relative movement of the weighted mass in response to the recoil action of the gun component. In addition, a stop or bumper may be disposed on the side of the weighted mass opposite from the spring to arrest return movement of the weighted mass. The weighted mass may be held between the spring and bumper in an "at rest" position, and any movement of the weighted mass in response to the recoil is in opposition to the spring. The spring is selected as a function of the weight of the weighted mass and intensity of the recoil action, and desirably is stiff enough to ensure that only the intensity of the recoil action will result in indexing of the counter. The spring also serves to protect the counting mechanism from the full impulse load of the gun recoil. In this regard, the spring may be selected so as to continuously compress during the entire recoil event. The spring also stores energy that is used to return the weighted mass to its at-rest position after the recoil event.

The counting device also includes a visual display of the total count of rounds fired. This display may be external to the housing, or contained within the housing and externally viewable through a window in the housing. In the embodiment wherein the counter constitutes the weighted mass, the display may be a feature of the counter and visible through a window in the housing in the at-rest position of the counter.

Aspects of the invention will be described in greater detail below with reference to a particular embodiment illustrated in the drawings.

BRIEF DESCRIPTION OF THE FIGURES

FIG. 1A is a perspective view of a tank having an embodiment of the inventive counting mechanism mounted at the muzzle of the tank's gun bore.

FIG. 1B is an enlarged perspective view of the muzzle end of the gun bore taken from FIG. 1A.

FIG. 2 is a front perspective view of an embodiment of the counting mechanism.

DETAILED DESCRIPTION

Figure 3:
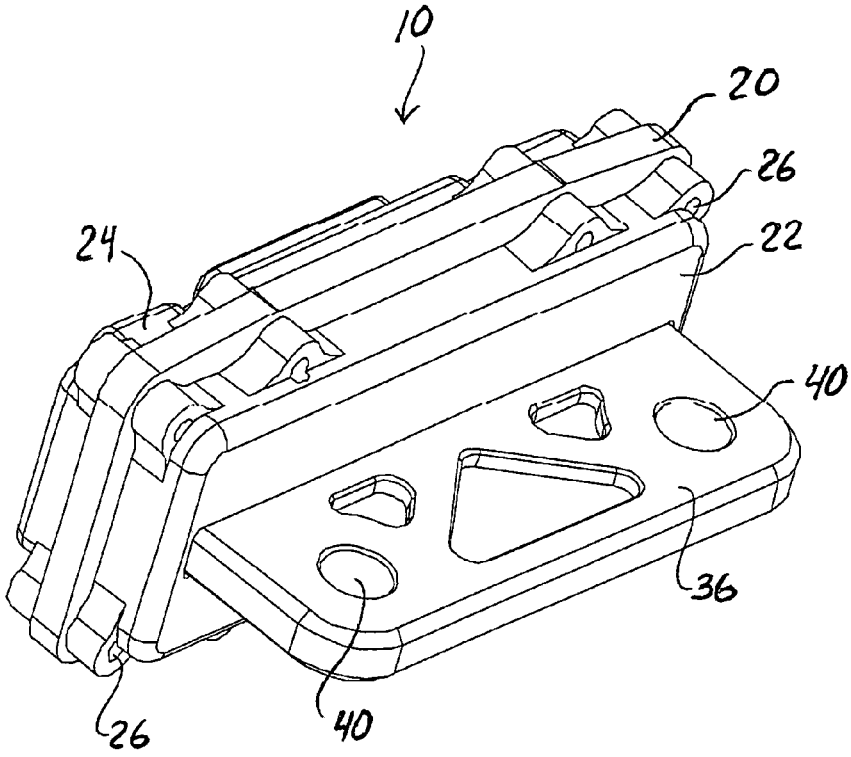
FIG. 3 is a back perspective view of an embodiment of the counting mechanism.

Reference will now be made in detail to examples of the invention, one or more embodiments of which are illustrated in the figures. Each example is provided by way of explanation of the invention, and not meant as a limitation of the invention. For example, features illustrated or described as part of one embodiment may be used with another embodiment to yield still a further embodiment. It is intended that these and other modifications and variations be included within the scope and spirit of the invention.

Referring to the figures in general, an embodiment of a counting mechanism 10 in accordance with the invention is illustrated. In FIGS. 1A and 1B, the mechanism 10 is illustrated mounted to a tank gun 12. The device 10 is mounted to the barrel 14 near the muzzle 16. Referring to FIG. 1B, it can be seen that this particular embodiment 10 is mounted to the gun sight 18 at the muzzle 16. As discussed in further detail below, the device 10 includes a mounting flange 36 for conveniently mounting the device 10 to any component of the gun 12 or artillery piece that experiences recoil action. It should be understood that the device 10 may be mounted to any conventional gun, armament, or other weapon that experiences recoil action upon firing of a round. Additionally, the device 10 need not necessarily be mounted on the gun barrel 14, but may be mounted to any part of the weapon or gun that experiences the recoil action.

In the illustrated embodiment, the counting mechanism 10 includes a housing 20 having a shape and configuration for mounting to a component of the gun, for example on the barrel 14 as illustrated in FIGS. 1A and 1B. The housing 20 is not limited by its shape or size, so long as the housing 20 can be readily accommodated on the gun component. The housing 20 may include multiple components, such as a back member 22 and a cover member 24. The cover member 24 may be sealed to the back member 22 by conventional means, such as screws or rivets 26, adhesive, welding, and so forth. The internal components of the counting mechanism 10 are contained within the interior volume defined by the back member 22 and cover member 24. It may be desired that the cover member 24 be sealed with respect to the back member 22, and any conventional sealing device or means may be utilized for this purpose. For example, referring to FIG. 4, a seal groove 34 may be defined in either or both of the back member 22 and front member 24, and any conventional seal or gasket material may be seated within the groove 34. In this way, when the front member 24 and back member 22 are joined together, a hermetic seal is formed between the components to protect the internal working components from the rigors of the battlefield environment.

The counting mechanism 10 may be mounted to the gun component by any suitable means. In the illustrated embodiment, the mechanism 10 includes a mounting flange 36 extending from the back housing member 22. The flange 36 may be an integral component of the back member 22, or a separate component joined to the housing 20. The mounting flange 36 includes mounting holes 40 that may be used to directly attach the device 10 to the gun component. For example, in the embodiment illustrated in FIG. 1*b*, the mounting flange 36 is bolted onto the base of the gun sight 18. It should be appreciated that the mechanism by which the counting mechanism 10 is mounted to the gun component is not a limiting feature.

A counting device, generally 46, is contained within the housing 20 and includes an actuator 48 that activates (i.e. increments) the counting device 46 for each recoil action of the gun component. An embodiment of the counting device 46 will be described in greater detail below.

A weighted mass, generally 50, is contained within the housing 20 and is movable relative to the housing in response to recoil action of the gun component. Means are provided for transferring relative movement of the weighted mass to the counting device to increment the device in response to the recoil action. For example, in a particular embodiment, the weighted mass 50 is operably configured with the actuator 48 and counting device 46 such that relative movement between the housing and weighted mass 50 upon discharge of a round from the gun results in triggering of the actuator and an increment to the counting device 46. The weighted mass 50 may be virtually any weighted component within the housing 20. For example, in one particular embodiment, the weighted mass 50 may be a separate component from the counting device 46 and, upon experiencing the recoil action, relative movement between the weighted mass 50 and the housing 20 causes the mass to engage the actuator 48 of the counting device 46. In this particular embodiment, the counting device 46 and actuator 48 may be stationarily mounted within the housing.

In the illustrated embodiment, the weighted mass 50 is actually one or more of the components of the counting device 46. Thus, it should be understood that the weighted mass 50 need not be a separate component from the counting device, and may include all or a portion of the components of the counting device 46. For example, the counting device 46 has a distinct weight and mass and may be movably mounted within the housing 20 so as to be slidable in a given direction relative to the housing 20 upon the gun component experiencing the recoil action. The actuator 48 moves with the counting device 46 and, at a certain position of the counting device 46, may engage stationary structure within the housing 20 that causes the actuator 48 to increment the counting device 46.

An embodiment of the movable counting device 46 is illustrated in the figures. In this embodiment, the counting device 46 includes a mechanically incremented counter, such as the geared counter 52. The geared counter 52 includes a frame 54 having a plurality of read-out gears 68 that are geared together and sequentially advanced by actuation of a cam wheel 64. In the illustrated embodiment, the counter 52 includes four readout gears 68. However, the number of read-out gears can be varied depending on the desired maximum number of counts. The read-out gears 68 have the numbers 0 to 9 printed or otherwise displayed on the round cylindrical portion of the gear. The numbers make up a visual display 74 that is visible through a window 38 in a portion of the housing, such as the front cover 24 as illustrated in FIG. 2.

Operation of the type of geared counter 52 illustrated in the figures is well known and need not be described in great detail herein. In general, each of the read-out gears 68 have a set of gear teeth on each side of the cylinder body. One set of teeth is incremented and the other set increments an adjacent gear. Each time a readout gear 68 is incremented, that particular gear 68 increments a respective carry-out gear that "carries" the 1 of a 9 to 10 transition to the next decimal place (i.e. the next read-out gear). The carry-out gears also have two sets of teeth. The first set, which is incremented by the respective read-out gear, has 20 teeth. The second set, which increments the next decimal place read-out gear at a 9 to 0 transition, has only two teeth. Therefore, for each ten increments from the previous read-out gear, the following read-out gear is incremented by one.

The counter 52 may be slidably contained within the housing 20 in numerous ways. In the illustrated embodiment, the counter 52 includes sliders 56 at one or more locations on the frame 54. The sliders 56 slide along a glide surface 32 (FIG. 5) defined in the housing back member 22. The sliders 56 are essentially bearing surfaces that make contact with the glide surface 32 and are used to decrease friction between the moving components. The sliders 56 may be made of, for example, bronze.

In the embodiment wherein the weighted mass constitutes the geared counter 52, the actuator 48 includes an indexer 58 that is slidable on the counter frame 54 in a direction generally transverse to the axis of the counter 52 and sliding direction of the counter 52 within the housing 20. The indexer 58 includes an indexing tab 62 that engages with the cam wheel 64. Displacement of the indexer 58 thus causes an incrementing of the counter 52.

Figure 5:
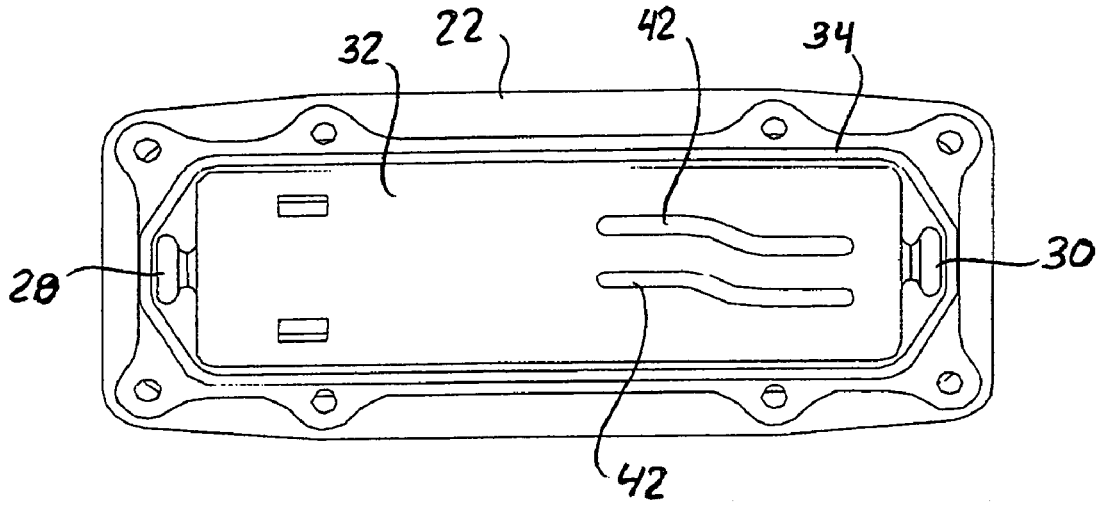
FIG. 5 is a perspective view of the base member of the housing from the embodiment of FIG. 4 with the internal components removed.

The relative linear sliding motion of the counter 52 may be transferred to the indexer 58 by various means. In the illustrated embodiment, the indexer 58 includes a pin 60 that engages between cam tracks 42 defined on the housing back member 22, as seen in FIG. 5. The cam tracks 42 define an angled path such that linear moment of the counter 52 within the housing 20 causes the indexer 58 to move from an at-rest position to an indexing position. Return movement of the counter 52 causes the indexer 58 to return to its at-rest position. It should be appreciated that the indexer 58 may be disposed so as to be actuated linearly along the same line of motion as the counter 52 within the housing 20. Any manner of structure or stop device within the housing may engage the indexer 58 and cause the indexer 58 to move in to its incrementing position.

Figure 6:
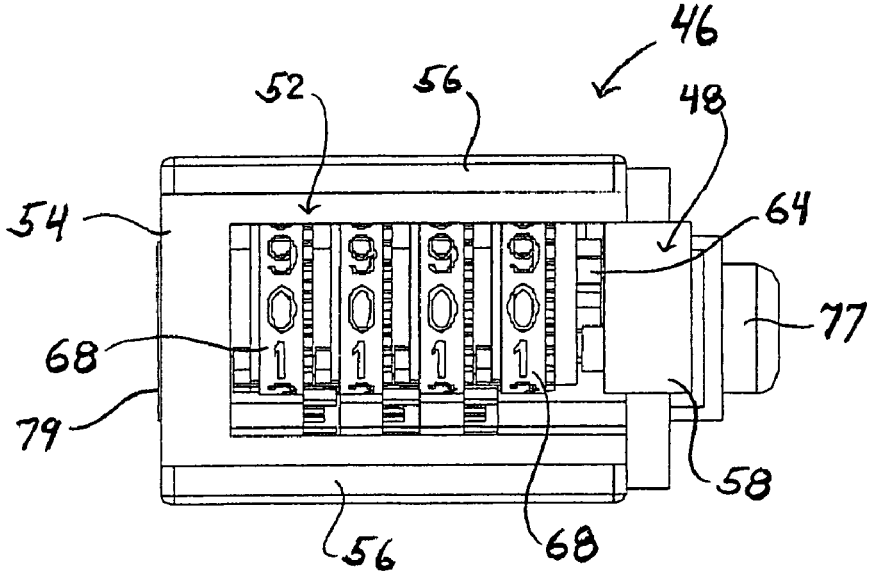
FIG. 6 is a front perspective view of a geared incrementing counter that may be used with the counting mechanism.
Figure 7:
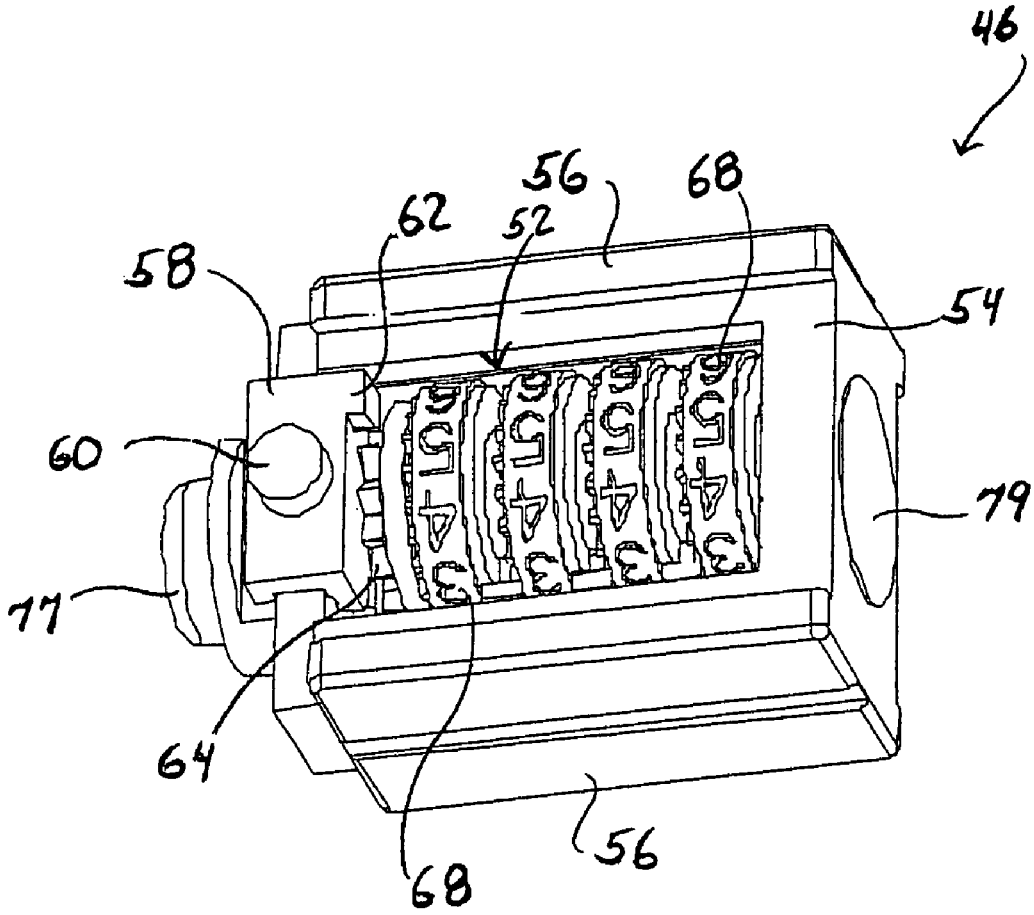
FIG. 7 is an alternate perspective view of the counter of FIG. 6 particularly illustrating the actuator mechanism.

A resilient device 70, such as a spring, may be disposed within the housing 20 to oppose movement of the weighted mass 50 in response to the recoil action of the gun component. In the illustrated embodiment, the spring 70 is held in position by way of a positioning member 71 (FIG. 3) fitted into a groove 30 (FIG. 5). The positioning member 71 includes an end that extends into the spring 70 and thus retains the spring in position relative to the housing 20. Similarly, a positioning member 77 (FIG. 6) may be provided on the counter frame 54 that engages in the opposite end of the spring 70. In this way, the spring is positively retained between the housing 20 and movable counter 52 (or other weighted mass 50).

Figure 4:
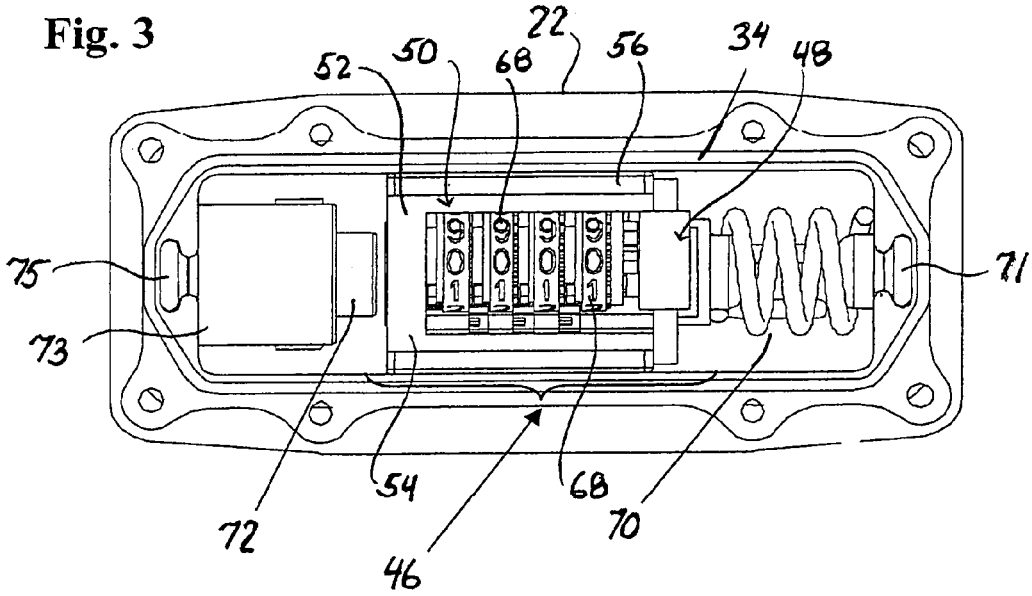
FIG. 4 is a front perspective view of the embodiment of FIG. 3 with the housing cover removed to reveal the internal components of the counting mechanism.

In addition, a stop or bumper 72 (FIG. 4) may be provided at the opposite end of the weighted mass 50. The bumper 72 may comprise any resilient material and may include a supporting body 73 with a positioning member 75 engaged in a correspondingly shaped groove 28 (FIG. 5) defined in the back cover 22. The bumper 72 is provided to arrest the return movement of the weighted mass 50. Referring to FIG. 4, it is thus seen that the weighted mass 50 (i.e. the movable counter 52) is held between the spring 70 and bumper 72 in an "at-rest" position, and any movement of the weighted mass 50 in response to the recoil action of the gun is in opposition to the spring 70. The spring 70 is thus selected as a function of the weight of the weighted mass 50 and the anticipated intensity of the recoil action. The spring 70 is desirably stiff enough to ensure that only the intensity of the recoil action will result in indexing of the counter 52. The spring 70 also serves to protect the counting device from the full impulse load of the gun recoil. In this regard, the spring 70 may be selected so as to continuously compress with movement of the weighted mass 50 during the entire recoil event. The spring 70 also stores the energy used to return the weighted mass 50 to its at-rest position after the recoil event.

In operation, when the gun is fired, the recoil action of the gun barrel 14 forces the housing 20 into the movable counter 52 (or other weighted mass), which causes compression of the spring 70. As the spring 70 is compressed, the recoil impulse of the gun is spread out over the duration of compression and the pin 60 on the indexer 58 travels through the cam tracks 42 defined on the housing back member 22. As the pin 60 moves through the cam tracks 42, the indexer 58 is moved in a transverse direction, which causes an incrementing of the cam wheel 64.

It should be appreciated by those skilled in the art that various modifications and variations can be made to the embodiment of the invention described and illustrated herein without departing from the scope and spirit of the invention. It is intended that the invention include such modifications and variations as come within the scope of the appended claims and their equivalents.

What is claimed is:

1. A counting mechanism for detecting and registering the number of rounds fired from a recoil gun, said mechanism comprising:

a housing, said housing having a shape and configuration for mounting to a barrel of the gun;

a counting device contained within said housing, said counting device indexed by recoil action of the gun barrel upon a round being discharged; and a movable weighted mass within said housing such that relative movement between said housing and said mass results with the recoil action of the gun barrel, said counting device operably configured with said mass such that the relative movement of said mass upon discharge of a round from the barrel causes indexing of said counting device;

wherein said counting device comprises an incrementing geared counter, and an actuator configured with said geared counter to cause indexing of said geared counter, said actuator operably configured with said weighted mass so as to be actuated by relative movement of said weighted mass to a defined position relative to said housing in response to the recoil action; and wherein said geared counter and actuator are movably mounted within said housing and constitute at least a component of said weighted mass.

2. The counting mechanism as in claim 1, wherein said geared counter is linearly slidable within said housing, and said actuator is movable in a direction transverse to movement of said counter in order to actuate said counter.

3. The counting mechanism as in claim 2, further comprising a cam track defined within said housing along which said actuator moves upon linear movement of said counter, said cam track moving said actuator in said transverse path.

4. The counting mechanism as in claim 2, further comprising a spring disposed within said housing to oppose movement of said counter in response to the recoil action.

5. The counting mechanism as in claim 2, further comprising a bumper disposed within said housing to arrest return movement of said counter after recoil of the gun barrel.

6. The counting mechanism as in claim 1, wherein said counting device comprises a visual display of a total count of rounds fired, said visual indication externally viewable through a window in said housing.

7. The counting mechanism as in claim 1, further comprising a spring disposed within said housing to oppose motion of said weighted mass in response to the recoil action, said spring having a stiffness selected as a function of the weight of the weighted mass and intensity of the recoil action such that the counting device is actuated only upon an actual firing of a round.

8. The counting mechanism as in claim 7, wherein said spring continuously compresses over the entire recoil duration of the gun barrel.

9. The counting mechanism as in claim 8, wherein stored energy in said spring returns said weighted mass to an at-rest position after the recoil action.

10. The counting mechanism as in claim 1, wherein said housing comprises a base member and a cover member, said cover member hermetically sealed to said base member.

11. A counting mechanism for detecting and registering the number of rounds fired from a recoil gun, said mechanism comprising:

a housing, said housing having a shape and configuration for mounting to a component of the gun exhibiting recoil from firing a round;

a counting device contained within said housing, said counting device incremented by recoil motion of the gun component upon a round being discharged;

means within said housing for transferring recoil movement of the gun component to said counting device such that said counting device is incremented for each round fired;

wherein said means for transferring comprises a weighted mass movable within said housing such that relative movement is produced between said housing and weighted mass in response to the recoil action, said relative movement causing said mass to increment said counting device; and wherein said weighted mass includes components of said counting device.

12. The counting mechanism as in claim 11, wherein said counting device comprises an incrementing counter and associated actuator that are linearly slidable within said housing in response to the recoil action, said actuator being actuated at a defined position of said counter within said housing.

13. The counting mechanism as in claim 12, wherein said means for transferring further comprises a cam track defined within said housing along which said actuator is driven as said counter moves relative to said housing.

14. A counting mechanism for detecting and registering the number of rounds fired from a recoil gun, said mechanism comprising:

a housing, said housing having a shape and configuration for mounting to a component of the gun exhibiting recoil from firing a round;

a counting device contained within said housing, said counting device incremented by recoil motion of the gun component upon a round being discharged;

means within said housing for transferring recoil movement of the gun component to said counting device such that said counting device is incremented for each round fired;

wherein said means for transferring comprises a weighted mass movable within said housing such that relative movement is produced between said housing and weighted mass in response to the recoil action, said relative movement causing said mass to increment said counting device;

wherein said weighted mass is operably configured with an actuator that increments said counting device at a defined position of said weighted mass within said housing; and wherein said means for transferring further comprises a cam track along which said actuator is driven with relative movement of said counter, said cam track defining a path resulting in actuation of said actuator.

* * * * *